US007334795B2

(12) United States Patent
Wonpu

(10) Patent No.: US 7,334,795 B2
(45) Date of Patent: Feb. 26, 2008

(54) METHOD FOR PLAYING A POKER GAME WITH MANY PLAYERS

(76) Inventor: John S. Wonpu, 3505 W. Gilmore Ave., North Las Vegas, NV (US) 89032

( * ) Notice: Subject to any disclaimer, the term of this patent is extended or adjusted under 35 U.S.C. 154(b) by 204 days.

(21) Appl. No.: 11/119,602

(22) Filed: May 2, 2005

(65) Prior Publication Data

US 2006/0214375 A1 Sep. 28, 2006

Related U.S. Application Data

(60) Provisional application No. 60/646,657, filed on Mar. 24, 2005.

(51) Int. Cl.
*A63F 1/00* (2006.01)

(52) U.S. Cl. ..... 273/274; 273/292

(58) Field of Classification Search ..... 273/274, 273/292; 463/12, 13
See application file for complete search history.

(56) References Cited

U.S. PATENT DOCUMENTS 5,118,109 A * 6/1992 Gumina ..... 273/139
5,718,430 A * 2/1998 Aramapakul et al. ..... 273/292
5,755,621 A * 5/1998 Marks et al. ..... 463/42
5,794,934 A * 8/1998 Malcolm ..... 273/292
6,042,118 A * 3/2000 Poitra ..... 273/292
6,250,685 B1 * 6/2001 Walker et al. ..... 283/49
6,435,500 B2 * 8/2002 Gumina ..... 273/139
6,572,107 B1 * 6/2003 Walker et al. ..... 273/139
6,896,265 B1 * 5/2005 Schlumbrecht ..... 273/292
6,923,446 B2 * 8/2005 Snow ..... 273/292
6,938,900 B2 * 9/2005 Snow ..... 273/292
7,128,319 B2 * 10/2006 Finocchio ..... 273/139
2004/0192425 A1 * 9/2004 Jarvis et al. ..... 463/12
2005/0212214 A1 * 9/2005 Pfeiffer et al. ..... 273/292
2007/0029730 A1 * 2/2007 Peterson ..... 273/292

* cited by examiner

*Primary Examiner*—William M. Pierce
(74) *Attorney, Agent, or Firm*—Craig Weiss & Moy, P.C.

(57) ABSTRACT

A method for playing a combination poker and lottery game with many players that allows players to receive at least two playing card designations that can be combined with three or more community cards to create at least one winning five card poker hand whereby no two players having the exact same at least two playing card designations even if one or more of the at least two playing card designations of one player is identical to one or more of the at least two playing card designations of another player.

17 Claims, 1 Drawing Sheet

METHOD FOR PLAYING A POKER GAME WITH MANY PLAYERS

CROSS REFERENCE TO RELATED APPLICATION

This application claims priority to a corresponding provisional application U.S. Ser. No. 60/646,657, filed Mar. 24, 2005 in the name of the applicant of this application.

FIELD OF THE INVENTION

This invention relates generally to card games and, more particularly, to a method for playing a combination poker and lottery game with many players that allows players to receive at least two playing card designations to be combined with three or more community cards to create at least one winning five card poker hand whereby no two players have the exact same at least two playing card designations even if one or more of the at least two playing card designations of one player is identical to one or more of the at least two playing card designations of another player.

BACKGROUND OF THE INVENTION

The card game of poker, with its many variations, has grown tremendously in popularity. The most popular poker games, such as Texas Hold'em and Omaha, provide each player with two to four unique cards that are then used in combination with five community cards to form the best five card poker hand. A standard deck of playing cards contains 52 unique cards which would limit direct play in a game like Texas Hold'em to no more than 23 players (with each player receiving two cards plus the five community cards). For all practical purposes, however, no more than 10 or 11 players can play against one another at a single table since it is necessary to be able to easily see each player at the table. In the game of Omaha, in which each player is provided with four playing cards, no more than 11 players can play directly against one another using a standard 52 card deck.

Several attempts have been made to increase the number of players who are able to play poker against one another. Poker tournaments provide many players with the opportunity to play in a single tournament, although often no more than 10 players are able to play directly against each other at any one table in a tournament. Hundreds of players and even thousands are able to play in single poker tournament either at actual tables or through the internet. Nevertheless, regardless of the number of players playing in a poker tournament, these tournaments still only allow players to play directly against no more than 10 or 11 players at any one time.

The various games of poker require a player to exercise judgment in determining when to bluff, when to hold playing cards and when to discard playing cards. Players can spend a lifetime trying to master the skill necessary to be successful at poker. The need for a certain level of skill has discouraged some players from playing the game of poker. Many versions of poker have been invented to address these concerns. Video poker, three-card poker and other types of poker games have eliminated the bluffing component, while also limiting betting discretion. Nevertheless, a player often must still exercise judgment over when to hold playing cards and when to discard playing cards.

Lottery-type games, such as keno, allow many players to play against one another for a large prize without the need to exercise judgment. A need therefore existed for providing a new, exciting variation of poker capable of combining the popular attributes of the game of poker with the lottery-type ability to allow many players to play against one another for a large prize without needing to exercise a great deal of judgment over how to play the game.

SUMMARY OF THE INVENTION

An object of the present invention is to provide a new method of playing a poker game with many players that provides each player with at least two playing card designations with no player possessing at least two playing card designations identical to each and every at least two playing card designations of another player and with at least three community cards to be combined with each player's at least two playing card designations to form the best winning poker hand.

BRIEF DESCRIPTION OF THE PREFERRED EMBODIMENTS

In accordance with the preferred embodiment of the present invention, a method of playing a poker game with many players is disclosed, comprising, in combination, the steps of providing each one of many players with a at least two playing card designations randomly generated from a source of 52 separate playing card designations corresponding to a standard 52 card deck of playing cards in a format that is visible to each one of the players wherein each player's combination of at least two playing card designations is different than all of the other players' combined at least two playing card designations even though each player may have some of the at least two playing card designations identical to some of the at least two playing card designations of at least one of the other players to thereby avoid having any two players of the many players playing the poker game having all of the at least two playing card designations being exactly the same, and randomly selecting at least three playing card designations from a source of 52 separate playing card designations corresponding to a standard 52 card deck of playing cards to be used as common community cards to thereby create a best winning five card poker hand for at least one of the players from a combination of the common community cards and the at least two playing card designations of at least one player.

The foregoing and other objects, features, and advantages of the invention will be apparent from the following, more particular description of the preferred embodiments of the invention.

DETAILED DESCRIPTION OF THE PREFERRED EMBODIMENTS

Figure 1:
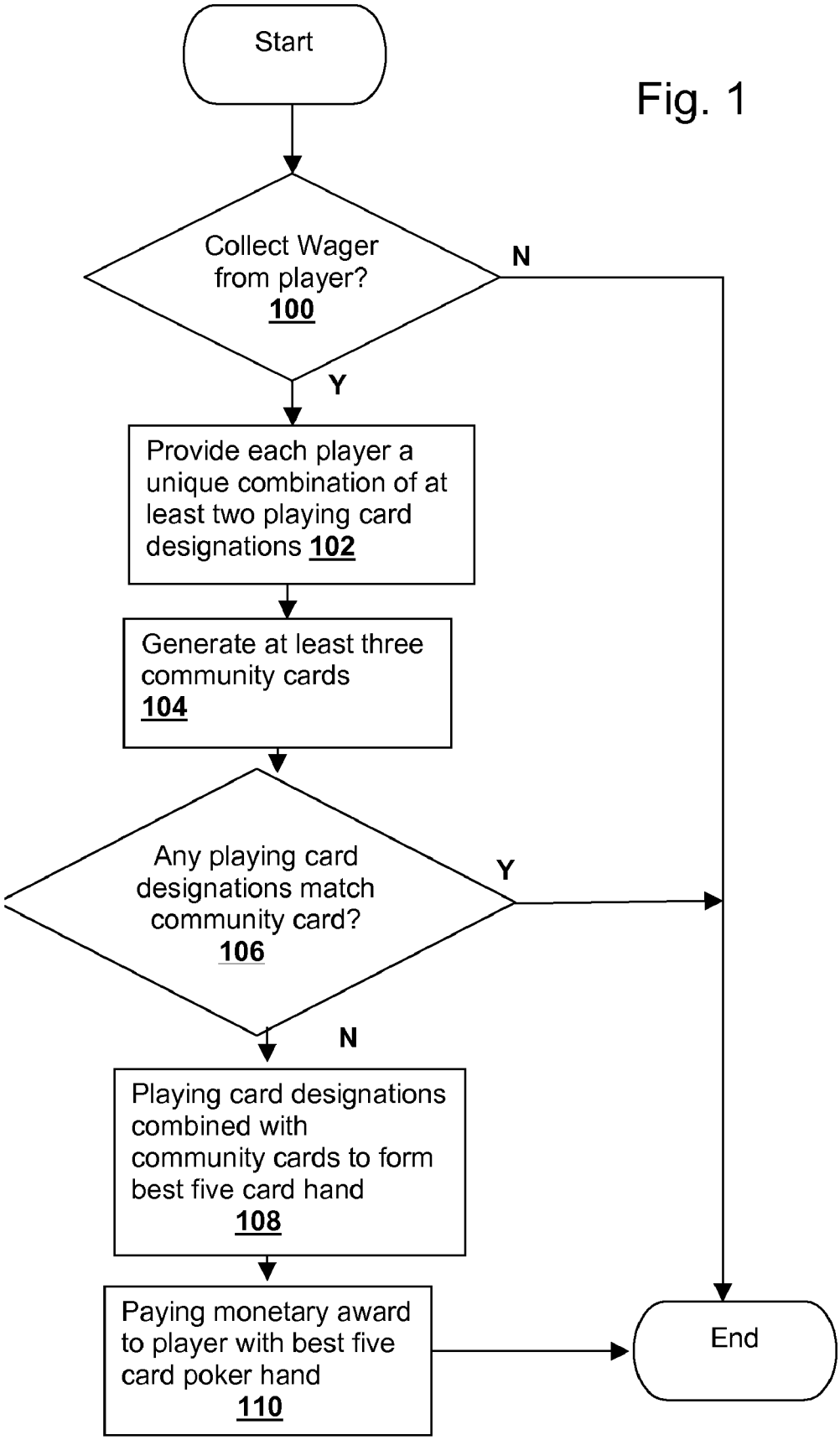
FIG. 1 is a flowchart depicting a method for playing a poker game with many players in accordance with an embodiment of the present invention.

The present invention discloses a method of playing a poker game with many players. In the preferred embodiment, each player is provided with at least two playing card designations randomly generated from a source of 52 separate playing card designations corresponding to a standard 52 card deck of playing cards. Preferably, the at least two playing card designations, for example 7 of Clubs and Jack of Hearts, is provided in a format that is visible to each player, such as a game card. Preferably, the game card is provided with a covering that must be uncovered by the player, such as the material used on a lottery ticket, which must be scratched off to reveal the data contained beneath. Further preferably, a database is provided which contains all of the at least two playing card designations distributed to each player with a corresponding reference number or reference symbol assigned to each of the at least two playing card designations. This same reference number or reference symbol is preferably printed on each game card. In this way, when a winning combination of at least two playing card designations is determined, a winning game card can more easily be identified by either the reference number or reference symbol (such as a bar code). While, in the preferred embodiment a game card or slip of paper is used to convey the at least two playing card designations to each player it should be clearly understood that substantial benefit could be derived from an alternative embodiment of the present invention in which other means, such as electronic means, are used to indicate to a player his or her at least two player card designations as well as other means to determine a winning player's at least two playing card designations.

Each player's combination of at least two playing card designations is different than all of the other players' combined at least two playing card designations even though each player may have one (if playing with two playing card designations) or more (if playing with three or more playing card designations) of the at least two playing card designations be identical to one (if playing with two playing card designations) or more (if playing with three or more playing card designations) playing card designations of another player. In this way, no player may have all of his or her at least two playing card designations be identical to all of the at least two playing card designations of any other player. For example, if Player A has a 7 of Clubs and a Jack of Hearts, it may be possible for Player B to have a 7 of Clubs and a Queen of Diamonds, and Player C to have a Jack of Hearts and a Queen of Diamonds so long as no player possesses each and every card identical to each and every card of another player. When a player receives three initial playing cards, for example, if Player A has a 7 of Clubs, a Jack of Hearts, and a Queen of Diamonds, it may be possible for Player B to have a 7 of Clubs, a Jack of Hearts and a Queen of Clubs, and Player C to have a 7 of Diamonds, a Jack of Hearts and a Queen of Diamonds and so on so long as no player possesses each and every card identical to each and every card of another player. The same goes for players receiving four initial playing card designations.

The next step in the method of playing a poker game with many players is to randomly select at least three, and preferably five, playing card designations from a source of 52 separate playing card designations corresponding to a standard 52 card deck of playing cards to be used as common community cards by all players. In this way, each player may combine his initial at least two playing card designations with the community cards in order to form a best possible five card poker hand, with the winning player possessing the best possible five card poker hand based on the combination of the at least two playing card designations and the community cards. While, in the preferred embodiment, five community cards are used, it should be clearly understood that substantial benefit could be derived from an alternative embodiment of the present invention in which as few as three and as many as six or more community cards are used so long as a combination of at least two playing card designations provided to each player can be combined in some way with the community cards to form a best five-card poker hand. In the preferred embodiment, a wheel is provided having 52 separate playing card designations corresponding to the 52 playing cards of a standard deck of poker. The wheel is then spun one time for every playing card designation that is produced to be a common community card. The wheel may be spun at various time intervals, for example every 3-5 minutes, in order to increase excitement as the common community cards are generated. While, in the preferred embodiment, a wheel is used to produce the common community cards, it should be clearly understood that substantial benefit could be derived from an alternative embodiment of the present invention in which some other device is used, such as an electronic device, to produce the common community cards, or in which the wheel produces the common community cards simultaneously, or in which the wheel produces the common community cards at time intervals which deviate, even substantially, from the preferred time intervals.

In one embodiment of the present invention, the best five-card poker hand formed by the combination of the at least two playing card designations and the common community cards is based on the standard poker ranking of winning hands. In an alternative embodiment, an alterative ranking of winning poker hands is used in which the order of best poker hand to worst poker hand is as follows: Royal Flush, Straight Flush, Four Of A Kind, Full House, Four Card Straight Flush, Flush, Straight, Three Of A Kind, Two Pair, One Pair and No Pair. This ranking is substantially the same as the standard ranking except for the fact that a four card straight flush is given a hand ranking value, and that value is greater than a flush but not as great as a full house. While, in this embodiment, an alternative hand ranking is used to determine a best possible winning poker hand, it should be clearly understood that substantial benefit could be derived from an alternative embodiment of the present invention in which the standard poker ranking is used, or some alternative ranking is used.

In one embodiment of the present invention, as many as 1,326 players may participate in a Texas Hold'em version of the poker game of the present invention, since this is the maximum number of combinations of two card designations in which no player has identical two playing card designations of another player. In this way, the poker game of the present invention allows as many as 1,326 players to compete against one another simultaneously in a single game of Texas Hold'em style poker. If three playing card designations are provided to each player, then a maximum of 22,100 players may participate and compete against one another in the game of the present invention. Three playing card designations may be provided to each player as part of either a "Mini-Omaha" type poker game, or as simply an additional card to be used in a Texas Hold'em type of game. If four playing card designations are provided to each player, then a maximum of 270,725 players may participate and compete against one another in the game of the present invention in either an Omaha-type of poker game or in a Texas Hold'em type of game in which additional cards are provided to each player.

In the preferred embodiment, each player is permitted to place a monetary wager of a pre-determined amount that is collected by a casino or some other entity in order for that player to participate in the poker game, with at least one player who has achieved the best winning five card poker hand being paid a monetary award by the casino or other entity based on a percentage of all of the monetary amounts collected from players playing the game. While, in the preferred embodiment, each player is permitted to place a wager and receive a monetary award based on a percentage of all wagers placed by all players, it should be clearly understood that substantial benefit could be derived from an alternative embodiment of the present invention in which players are able to participate in the game without placing a wager while still qualifying for a monetary award (or some other type of award) to be provided by a casino, gaming establishment or some other entity hosting the game, or in which no monetary award is provided.

Referring now to FIG. 1, a flowchart is shown depicting a method for playing a poker game with many players in accordance with an embodiment of the present invention. In the preferred embodiment, if a wager is collected from a player in order for the player to participate in the poker game (decision 100), then each player is provided with a unique combination of at least two playing card designations (step 102). Then, at least three community cards are generated (step 104). If any of the playing card designations provided to each player match any of the community cards (decision 106), then that player's at least two playing card designations are disqualified from play. Next, all remaining players having at least two playing card designations not previously disqualified combine the at least two playing card designations with the community cards to form the best possible five-card poker hand (step 108). Finally, a monetary award is paid to at least one player having the best five card poker hand (step 110).

In the preferred embodiment in which each player places a wager to participate in the poker game, each player, after having received the at least two playing card designations, is provided with the opportunity to withdraw from continuing to play the poker game and receive back a portion of the monetary wager made by that player. For example, if a player were to wager $7 to participate in the poker game of the present invention, then that player, if dissatisfied with their at least two playing card designations, could voluntarily withdraw from continuing to play the poker game and receive back a portion of their initial $7 wager. In the present example, the voluntarily withdrawing player would preferably receive a refund of $5, or more than twice the amount forfeited. Further preferably, for each community card that the player decided to see before then deciding to voluntarily withdraw, the player preferably would be refunded an amount less than that player would have otherwise received had that player voluntarily withdrawn prior to seeing the community card just revealed. For example, if a player who wagered $7 elected to voluntarily withdraw after seeing the first community card, then that player would preferably only be entitled to a refund of $4, as opposed to the $5 that that player could have received had that player voluntarily withdrawn from the game prior to the announcement of the first community card. Similarly, waiting for the second community card to be announced before withdrawing would merit a refund of $3; waiting for the third community card to be announced before withdrawing would merit a refund of $2; waiting for the fourth community card to be announced before withdrawing would merit a refund of $1; and waiting for the fifth and final community card to be announced ends the game and therefore precludes the player from voluntarily withdrawing (resulting in a total loss of the initial $7 wager, assuming that the player did not win). While, in the preferred embodiment, a player is provided with the opportunity to voluntarily withdraw from the poker game in exchange for a refund which decreases in value as the game progresses, it should be clearly understood that substantial benefit could be derived from an alternative embodiment of the present invention in which refund amounts vary, even substantially, from the preferred refund amounts, or in which only one opportunity to withdraw is provided and therefore only one refund amount, or in which no opportunity to withdraw is provided.

In one embodiment of the method of playing a poker game of the present invention, pairs of 8's, 9's, 10's, Jacks, Queens, Kings and Aces are eliminated from the pool of possible at least two playing card designations that a player may receive. In this way, no player can receive a pair of 8's or better. The purpose of this restriction would be to discourage players from voluntarily withdrawing from the game unless they received one of the "quality" starting hands of a pair of 8's or better. While, in this embodiment, pairs of 8's, 9's, 10's, Jacks, Queens, Kings and Aces are eliminated from the pool of possible at least two playing card designations that a player may receive, it should be clearly understood that substantial benefit may be derived from an alternative embodiment of the present invention in which there is no restriction on the types of cards that may be comprise the at least two playing card designations provided to each player, or in which the restriction deviates, even substantially, from the preferred restriction. For example, it may be beneficial to eliminate only pairs of face cards from distribution.

In one embodiment of the present invention, additional cards from the group of playing cards 2, 3 and 4 are added to the standard 52 card deck of playing card designations from which the common community cards are randomly selected. For example, an additional three 2's, two 3's and one 4 could be added, resulting in a 58 card deck that is used to generate the common community cards. These additional cards may possess a unique suit, such as the symbol of the sun, a square (as opposed to a diamond), a triangle (instead of a heart), and so on in order to prevent any of the more than 52 cards being exactly the same. The purpose of adding additional low cards (such as cards from the group of playing cards 2, 3 and 4) is to increase the likelihood that those cards would become common community cards. With an increased likelihood that a 2, 3 or 4 may become a common community card, a player having a 2, 3 or 4 among their at least two playing card designations will value such cards more than their standard low value. Adding low cards to the standard 52 cards used to generate the common community cards encourages players to remain in the game with what would otherwise be less desirable cards. This embodiment is for use with the version of the game in which players may voluntary withdraw from the game after receiving their initial at least two playing cards. While, in this embodiment, additional low cards are added to the standard 52 playing card designations corresponding to the standard 52-card deck to be used to generate the common community cards, it should be clearly understood that substantial benefit could be derived from an alternative embodiment of the present invention in which no additional cards are added to the deck, or in which cards other than 2, 3 and 4 are added, or in which the initial at least two playing card designations provided to each player are manipulated by the casino or other entity to create parity between all said at least two playing card designations.

In the preferred embodiment of the present invention, each player is subject to being automatically withdrawn from the poker game at any time that any one of the common community cards matches any one of the at least two playing card designations held by that player. For example, if a player holds the cards Ace of Clubs and King of Hearts and the first three common community cards are Ace of Spades, Ace of Hearts and Ace of Clubs, the player does not have a poker hand of four aces, but rather that player is automatically withdrawn from the game since that player's Ace of Clubs matches the Ace of Clubs which is one of the community cards. Preferably, any player that is automatically withdrawn from the poker game is refunded at least a portion of the initial wager amount, with the refund amount preferably decreasing with each additional common community card that is revealed. However, it should be clearly understood that substantial benefit could be derived from an alternative embodiment of the present invention in which players are not automatically withdrawn when one of their initial playing card designations matches one of the community cards, or in which only that playing card is disqualified from being used, or in which the refund amount deviates from the preferred amounts (possibly with the refund amount increasing, rather than decreasing in size with each revealed community card), or in which there is only a single refund amount, or in which there is no refund at all if a player is automatically withdrawn, or in which a subsequent free entry to play the game is provided as opposed to a refund. For example, in the mini-Omaha or three initial card embodiment of the poker game of the present invention in which each player is provided with three initial playing card designations, a player may have one card of the three initial playing cards match one of the common community cards and nevertheless be permitted to remain in the game, but only be permitted to use the remaining non-matching two initial playing card designations (or in an alternative embodiment, a player starting with three initial playing card designations that subsequently match two common community cards may be permitted to remain in the game, but only be permitted to sue the sole remaining non-matching playing card designation). Similarly, in the Omaha or four initial card embodiment of the poker game of the present invention, a player may have one or two cards of the four initial playing cards match one or two of the common community cards and nevertheless be permitted to remain in the game, but only be permitted to use the remaining non-matching two or three initial playing card designations (or in an alternative embodiment, a player starting with four initial playing card designations that subsequently match three common community cards may be permitted to remain in the game, but only be permitted to sue the sole remaining non-matching playing card designation).

In one embodiment of the present invention, in which Omaha high-low is played, a monetary award is paid to the at least one player having the best high hand and the at least one player having the best low hand. This award may be divided either equally or disproportionately between the best high hand and the best low hand. For example, the high hand may be awarded a much higher monetary award, with the best low hand being awarded a pre-determined amount or percentage of the total prize money.

Typically, the game of poker involves each player attempting to form the best five-card hand. Several variations of poker, however, allow players to form six-card hands, seven-card hands, and other combinations. For example, a six-card or seven-card straight or flush is possible, as well as other combinations that involve matching six or more cards. In one embodiment of the present invention, a player who is able to mach his or her at least two playing card designations with four community cards to form a six-card hand, or a player matching his or her at least two playing card designations with five community cards to form a seven-card hand may be awarded a bonus monetary award, such as three to five percent of the total prize money. While, in this embodiment, a bonus award is provided to players who combine their at least two playing card designations with four or more community cards to form a six-card or seven-card hand, it should be clearly understood that substantial benefit could be derived from an alternative embodiment of the present invention in which no bonus award is provided for players achieving a six-card or seven-card hand, or in which a player is provided with a bonus award for achieving a six-card hand or seven-card hand that is formed from a combination of three or more cards provided to the player and two or three common community cards.

In the preferred embodiment of the present invention in which two playing card designations are provided to each player, each player must use both of the two initial playing card designations in combination with the community cards to form a best five card poker hand, however it should be clear that substantial benefit could be derived from an alternative embodiment of the present invention in which a player may use as few as one or even none of the provided initial playing cards to be combined with the community cards to form the best five card poker hand.

While the invention has been particularly shown and described with reference to preferred embodiments thereof, it will be understood by those skilled in the art that the foregoing and other changes in form and details may be made therein without departing from the spirit and scope of the invention.

I claim:

1. A method of playing a poker game with many players comprising, the steps of:

generating a random and unique combination of at least two playing card designations from a source of 52 separate playing card designations corresponding to a standard 52 card deck of playing cards, wherein each combination of said at least two playing card designations is different than all other combinations of at least two playing card designations even though some combinations of at least two playing card designations may contain at least one playing card designation being identical to at least one playing card designation of another combination of at least two playing card designations;

providing each one of a plurality of players with said unique combination of at least two playing card designations;

generating randomly at least three playing card designations from a source of 52 separate playing card designations corresponding to a standard 52 card deck of playing cards to be used as common community cards;

comparing each said combination of at least two playing card designations of each said plurality of players with said at least three community card designations;

disqualifying any combination of at least two playing card designations having at least one playing card designation being identical to any community card designation;

comparing said combination of at least two playing card designations of each said plurality of players not disqualified with said at least three community card designations in order to determine a best possible five-card poker hand; and declaring at least one non-disqualified combination of at least two playing card designations as a winning hand.

2. The method of claim 1 including the steps of:

collecting a monetary wager by each one of said players of a pre-determined amount in order for each player to qualify for the poker game; and paying at least one remaining player who has received the best winning five card poker hand a monetary award that is derived from a percentage of all of the monetary amounts collected from players playing the game.

3. The method of claim 2 further comprising the steps of:

providing each player a unique combination of exactly two playing card designations;

generating a first set of three playing card designations randomly selected to serve as community cards;

generating a fourth playing card designation randomly selected to serve as a community card; and generating a fifth playing card designation randomly selected to serve as a community card, wherein said poker game is played substantially as a Texas Hold'em poker game.

4. The method of claim 2 including the step of providing each player who may be dissatisfied with said at least two playing card designations with an opportunity to withdraw from continuing playing said poker game and thereby receive back a portion of the monetary wager made by that player.

5. The method of claim 4 further providing the step of providing each player who is in said poker game after electing not to withdraw after receipt of their initial at least two playing card designations with second option to withdraw from said poker game after up to four community cards are generated and receive back a pre-set designated monetary amount for exercising said second option to withdraw.

6. The method of claim 2 wherein players having one of their at least two playing card designations matching one of said at least three community card designations are permitted to receive back a portion of their monetary wager.

7. The method of claim 2 further comprising the step of paying a player having a high winning hand a higher percentage of said monetary award than a player having a low winning hand when a hi-lo game of poker is played.

8. The method of claim 2 further comprising the step of paying a player a monetary award when a player combines said at least two playing card designations with four community card designations to form a six-card poker hand.

9. The method of claim 2 further comprising the step of paying a player a monetary award when a player combines said at least two playing card designations with five community card designations to form a seven-card poker hand.

10. The method of claim 1 further comprising the step of providing a game card to each player who has initially entered the poker game with the initial at least two playing card designations for each player printed on said game card.

11. The method of claim 10 further comprising the step of uncovering a covering material on said game card that covers the at least two playing card designations in order to view the at least two playing card designations.

12. The method of claim 10 further comprising the steps of:

providing a database containing all at least two playing card designations with at least one of a corresponding reference number and reference symbol assigned to each at least two playing card designations;

printing at least one of said reference number and said reference symbol corresponding to said at least two playing card designations on each said game card; and determining at least one winning five card poker hand based on at least one of said reference number and said reference symbol printed on said game card of said winning at least two playing card designations.

13. The method of claim 1 further comprising the steps of:

providing each one of said players in said poker game with said unique combination of three initial playing card designations;

comparing any two of said three initial playing card designations with said at least three community card designations to create at least one best winning five card poker hand.

14. The method of claim 1 further comprising, the steps of:

providing each one of said players in said poker game with said unique combination of four initial playing card designations;

comparing any two of said four initial playing card designations with said at least three community card designations to create at least one best winning five card poker hand.

15. The method of claim 1 further comprising the steps of:

providing a wheel having 52 separate playing card designations corresponding to the 52 playing cards of a standard deck of poker; and spinning said wheel one time each for each of said at least three playing card designations in order to produce said common community cards.

16. The method of claim 1 further comprising the step of eliminating from said at least two playing card designations provided to each player pairs of at least one of 8, 9, 10, Jack, Queen, King and Ace.

17. The method of claim 1 further comprising the steps of:

providing a plurality of additional playing card designations from the group of playing cards 2, 3 and 4, having an alternative suit from the standard suits of clubs, hearts, diamonds and spades to be used in addition to said 52 separate playing card designations corresponding to a standard 52 card deck of playing cards; and randomly selecting at least three playing card designations from a new combination of said plurality of additional playing card designations and said 52 separate playing card designations to be used as community cards to thereby create a best winning five card poker hand for at least one of the players from a combination of said common community cards and said at least two playing card designations of at least one player.

* * * * *